US005823710A

United States Patent [19]

Dooley

[11] Patent Number: 5,823,710

[45] Date of Patent: Oct. 20, 1998

[54] ENGINEERED WOOD STRUCTURES

[75] Inventor: James H. Dooley, Federal Way, Wash.

[73] Assignee: Silverbrook Limited, Federal Way, Wash.

[21] Appl. No.: 844,610

[22] Filed: Apr. 21, 1997

[51] Int. Cl.[6] ..... E02B 3/06

[52] U.S. Cl. ..... 405/29; 405/15

[58] Field of Search ..... 405/15, 16, 21, 405/29, 30, 33, 35; 52/233

[56] References Cited

U.S. PATENT DOCUMENTS

| | | | |
|---|---|---|---|
| 3,991,576 | 11/1976 | Tazaki et al. | 405/21 |
| 4,196,694 | 4/1980 | Buchanan | 119/3 |
| 5,174,681 | 12/1992 | Atkinson et al. | 405/34 |
| 5,238,325 | 8/1993 | Krenzler | 405/21 |
| 5,272,829 | 12/1993 | Roberts et al. | 43/4 |
| 5,678,954 | 10/1997 | Bestmann | 405/24 |

*Primary Examiner*—Tamara L. Graysay
*Assistant Examiner*—Gary S. Hartmann
*Attorney, Agent, or Firm*—Keith D. Gehr

[57] ABSTRACT

The invention is an engineered wood structure especially well suited to act as large woody debris in stream and lake rehabilitation projects. It is made using a number of small logs, typically about six to ten, assembled into a cylindrical or frustroconical structure. Normally, spaced apart opposing log pairs are joined by spars mortised into them at each end. Adjacent logs may additionally be doweled together at their ends. The spars are sufficiently displaced longitudinally so that they do not interfere spatially with each other although they may be in contact. Radial protrusions may be placed at one end or along the structure to simulate the root wad or limbs of a fallen tree and to provide anchoring when the structure is in place. A central cavity may be filled with rocks to reduce buoyancy and provide further anchoring. The structure can be field assembled in any location using only hand tools.

26 Claims, 2 Drawing Sheets

ENGINEERED WOOD STRUCTURES

The present invention is directed to engineered wood structures and the method of their assembly. The structures are especially well suited to act as large woody debris in stream rehabilitation projects and can be field assembled in any location using only hand tools.

BACKGROUND OF THE INVENTION

For many years it had been a practice to remove debris, such as logs or brush piles from streams. In many cases this was ostensibly to enhance appearance and visual esthetics or improve hydraulic conveyance. Unfortunately, the ultimate result was more usually detrimental to the stream and its faunal inhabitants, both insect and vertebrate. Natural pools were lost and streams tended to fill and braid. The result was frequent loss of habitat and greatly changed hydraulic characteristics.

Stream habitat restoration and management reportedly began in the United States in Michigan in 1927. Early structures were designed and installed with little understanding of the ecology of stream systems. Most structures were approached as civil works. It wasn't until the 1970s that aquatic biologists, fisheries scientists and hydrologists began to more fully understand the role of woody debris in stream ecosystems and the associated limitations of artificial in-stream structures. By the early 1980's the role of large woody debris associated with old-growth forests became the focal point for intense study. Today, stream restoration and improvement projects almost universally include large woody debris elements. A large body of literature has developed relative to the importance of large woody debris and its most efficient placement in streams.

Large woody debris is not uniformly defined among stream ecologists but historically it has usually been considered as fallen trees and logs with major diameters of about 80 cm or greater. In northwestern United States the term is almost universally used in reference to the fallen large trees found in virgin old growth forests. These trees frequently have been uprooted from stream banks by undercutting and retain large root wads that help to anchor and stabilize them. They are of sufficient size and weight to resist significant downstream movement in all but major floods.

While organic debris of all sizes is generally recognized as important for maintaining the biotic and abiotic functions of stream channels, large woody debris is critical. Large woody debris has a major influence on channel form, sediment transport and deposit patterns, as well as its contribution to organic cycling. The quantity of large woody debris in a channel system is highly correlated with the number of pools. Current efforts to protect riparian vegetation are expected to yield significant quantities of woody debris in the 0.1 m–0.5 m class. Many experts state that large woody debris of historical proportions (0.8–1.5 m) will be lacking for at least the next hundred years.

The demand for large woody debris to use in stream restoration has resulted in scarcity and rapidly increasing costs. The dominant source of large woody debris is from flood debris clean-up, land clearing, and road building projects. Contractors now recognize that waste wood and stumps have a market value and the cost has risen accordingly.

Modification of stream channels to improve habitat dates from the early 1900s. The most common methods to improve or manage instream habitat and/or hydrology include current deflectors, low-head dams, weirs, planted vegetation and boulder placement. Placement of large woody debris is a relatively recent advancement, driven by a recognition that it provides many previously under-appreciated functional values. Because of the scarcity of large woody debris and high expense for placement, logs of intermediate size (25–50 cm diameter), with or without root wads attached, are placed in the stream and anchored to the bedrock, anchor rocks, or stream banks with steel cables. Cabling is necessary to prevent the relatively light logs from being washed downstream where they might collect in log jams or against public structures. This approach has a number of limitations. First, the logs used are otherwise merchantable and have significant value. Second, moving and placing the logs requires heavy equipment or cable systems. Third, the required steel cabling is expensive to install and adds a very unnatural element to the landscape. Native large woody debris often weigh 3,000 to 5,000 kg, necessitating access to the site by very large cranes and equipment.

One suggested alternative to large woody debris has been the use of "brush-bundles". These are crafted by bunching tree tops or limbs in a grapple and binding them together with cable wrapping or steel bands. Such a solution may offer many of the performance functions of large woody debris, but introduces unnatural elements to the landscape when the bundles inevitably break-up from degradation or flood-induced damage. Other alternatives are wooden frame structures and stone filled gabions, both being foreign elements in a natural environment.

Roberts et al., U.S. Pat. No. 5,272,829, show an artificial stump said to be useful as a fish attracting device. However, this is not intended for stream flow control.

The present invention is an engineered alternative to native large woody debris that can be crafted and placed by crews working with limited equipment in remote sites. It is environmentally acceptable, cost-competitive with native debris, available in essentially unlimited volumes, and blends with the natural environment when it inevitably breaks up in a flood or degrades with time.

SUMMARY OF THE INVENTION

The present invention is an engineered wood structure and its method of manufacture. The product can be advantageously substituted for native large woody debris. It can be assembled and positioned on site by a small crew working with hand tools. No heavy equipment is necessary. The required materials can often be found on site or easily manually transported from a nearby road.

The structure is made from a number of small logs assembled in a unique manner. By "small log" is meant one that will not normally be less than about 100 mm at its smallest diameter or more than about 300 mm at its largest diameter. These can be tree tops from logging operations that might otherwise be wasted, logs from thinning operations or other sources such as merchandiser scrap, or as noted, can often be found and cut on site. Most generally, in the lengths required which will seldom be much longer than about 6 meters, their weight is such that one log can be readily handled by two or four workers using timber carrier tongs.

In one version of the invention, an even numbered plurality of the small logs, typically about six to ten, are assembled in side-by-side contact around a longitudinal axis into a generally cylindrical or frustroconical structure. Logs located on opposite sides of the structure are joined into pairs by at least two spars, one spar being located near each end of the logs. Each spar lies on a line defining a diameter of the structure so that the spars are essentially normal to and pass through the longitudinal axis of the structure. The spars joining adjacent log pairs are sufficiently displaced longitudinally so that the spars of one pair do not interfere spatially with the spars of an adjacent pair, although they may be in contact. The structures are built up one log pair at a time. The second pair of logs is displaced clockwise or counterclockwise from the first so that they begin to describe the cylindrical or frustroconical structure around the longitudinal axis. When the logs and spars are fully assembled they form a strong, rigid, interlocked structure capable of being handled and deployed as a unit.

In another version, not necessarily all but at least two pairs of logs located opposite each other on the structure are joined by spars as just described. Logs adjacent to these are united to them by dowels at one or preferably both ends of the structure. The dowels are placed so that they lie generally tangential to a circle centered on and normal to the longitudinal axis.

A structure may be assembled on a stream bank and then dragged into place or it may be assembled directly in a shallow stream at its desired final location. Except for the space occupied by the spars, the interior will be essentially hollow and open at each end. The interior may be filled with rock ballast prior to assembly of the last log to add weight and density to assist in maintaining it in a desired location in the stream.

It is an object of the invention to provide a wood structure that simulates natural large woody debris desirable for maintaining a healthy stream ecology.

It is another object to provide a wood structure that can be constructed and positioned on site without the need for large equipment It is a further object to provide a wood structure having a cross-section and length that are proportional to stream bed dimensions and flow conditions.

It is yet an object to provide a structure that has sufficient mass, specific gravity, and other features to keep it in place during all but the most severe stream flows.

It is similarly an object to provide a structure of the type described that has high hydraulic roughness, high physical surface roughness to trap sediments and small debris, and maximum surface area to cross-section area ratio.

It is an additional object to provide a structure having a natural appearance after placement to blend with the stream corridor scene.

It is still an object to provide a structure for placement in streams whose components are natural to the stream so that when the structure ultimately fails from decay or breaks up in a flood flow the small debris size minimizes impact on the downstream environment.

These and many other objects will become readily apparent upon reading the following detailed description, taken in conjunction with the drawings.

DETAILED DESCRIPTION OF THE PREFERRED EMBODIMENTS

Figure 1:
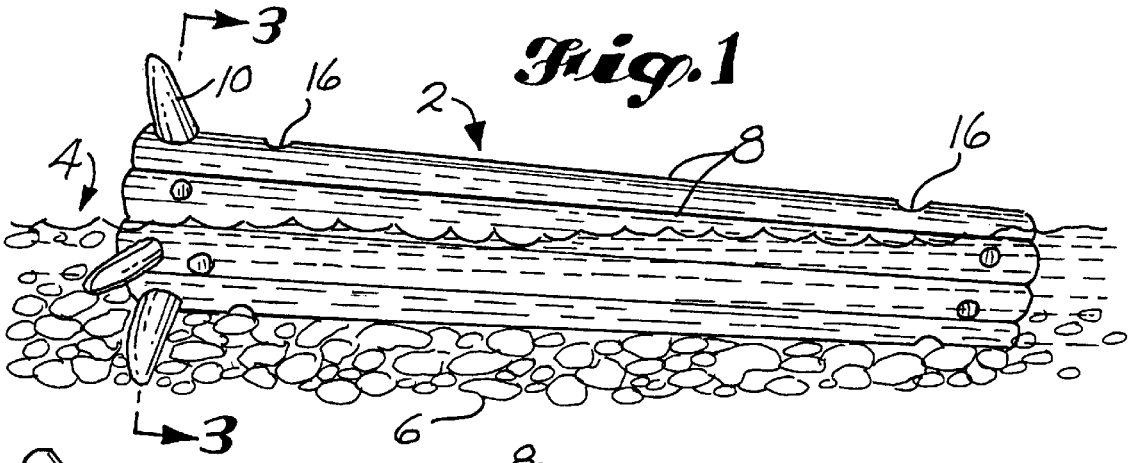
FIG. 1 is an example of a completed structure lying in a stream bed.
Figure 2:
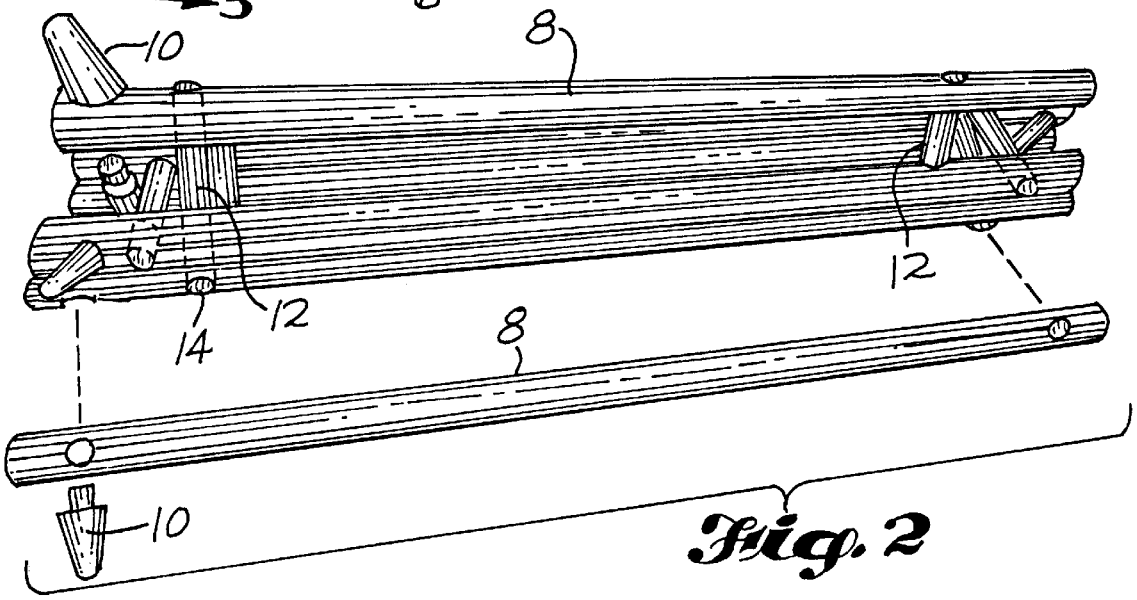
FIG. 2 is an example showing construction of the structure with the last log about to be placed in position.
Figure 3:
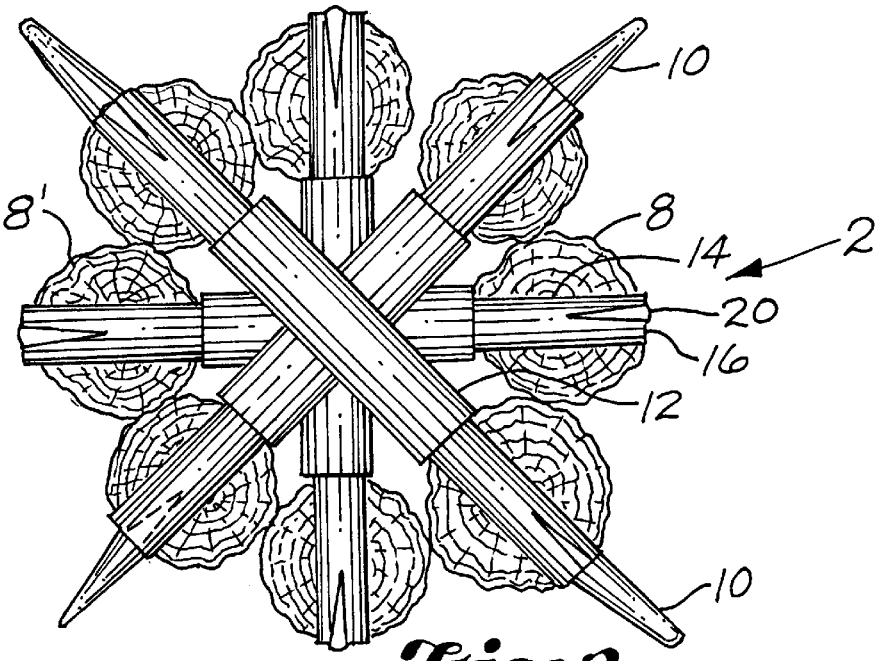
FIG. 3 is a cross section of the structure along line 3—3 of FIG. 1.

The structure of the present invention is an engineered alternative to native large woody debris for stream, lakeside, and upland habitat creation, restoration or improvement. It may be readily assembled on-site from smaller diameter poles or logs to make large diameter organic structures that satisfy the same functional requirements as native large woody debris. All materials and equipment necessary to assemble and install the structures can be packed into a site by a small work crew. The structures of the invention satisfy an economic and viable alternative for hydrologists and habitat specialists faced with limited availability of or poor site access for native large woody debris.

Reference now should be made to the drawings, particularly FIGS. 1–7, to readily understand the structure and its method of construction. A fully assembled structure 2 is seen simulating large woody debris in a stream 4 and is resting on stream bottom gravels 6. It is comprised of a number of small logs 8 assembled around a central longitudinal axis. Generally radially oriented protrusions 10 simulate the root wad of a fallen tree. These serve to help maintain the structure in place and, in addition, help to give the structure the natural appearance of a fallen tree. It will be evident that they may be located at any longitudinal position on the structure and not only at one end. The protrusions may be machined into a rough generally conical configuration or they may be formed from unmodified native material. They may be mortised into the logs in the same manner as will now be described for the spars 12.

Figure 4:
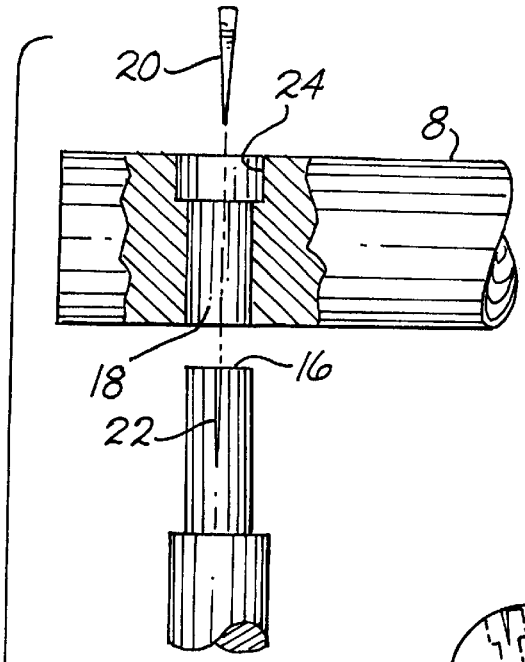
FIGS. 4 and 5 are details in partial cross section of the method of attachment of the spars to the longitudinal logs.
Figure 5:
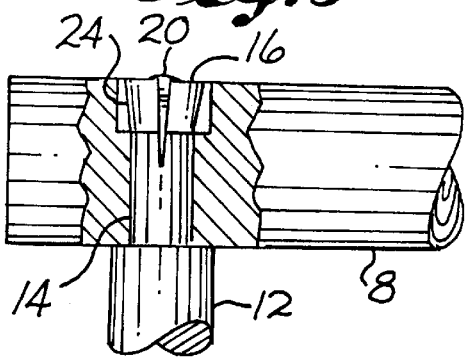

Opposite pairs of logs 8, 8' are united into opposing pairs by spars 12. One spar is located near each end. Additional spars can be more centrally located but are not normally necessary. FIGS. 4 and 5 show the joint between the logs and spars in partial cross section. This is seen in perspective views in FIGS. 6 and 7. Each end of the spars 12 is formed into a tenon 14 whose outer ends are seen at 16 in the fully assembled structure. These tenons are fit into corresponding mortises 18 bored into the logs. They may be tightly fixed in place by wedges 20 driven into corresponding slots or cuts 22 formed in the ends of the tenons. The outer end of bores 18 in the log may be made to a somewhat larger diameter 24 than the rest of the bore. This enables the ends 16 of tenons 14 to be expanded by wedges 20 and form a tight and permanent lock in logs 8. Alternatively, the bores 18 could be uniformly tapered to accomplish the same purpose. Other possible configurations of mortise openings, tenons, and wedges will be readily apparent to those skilled in the art.

Figure 8:
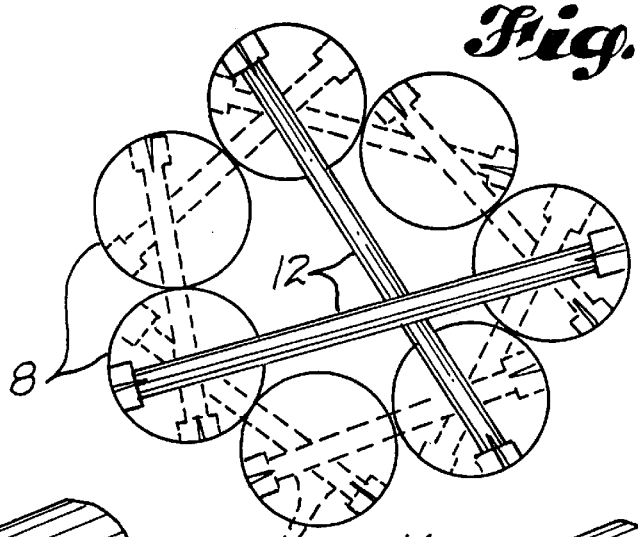
FIG. 8 shows an alternative method of joining the logs to each other in which the number of needed spars is reduced.
Figure 6:
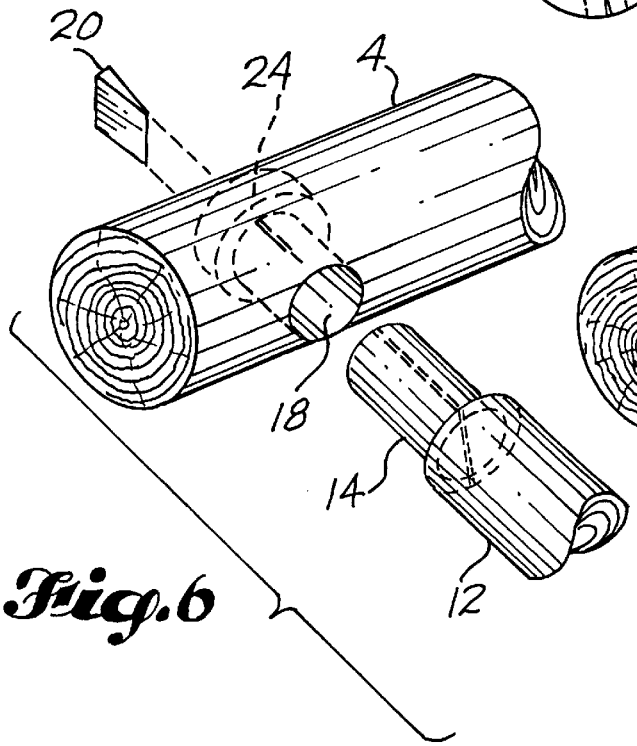
FIGS. 6 and 7 are details in perspective showing the method of attachment of the spars to the longitudinal logs.
Figure 7:
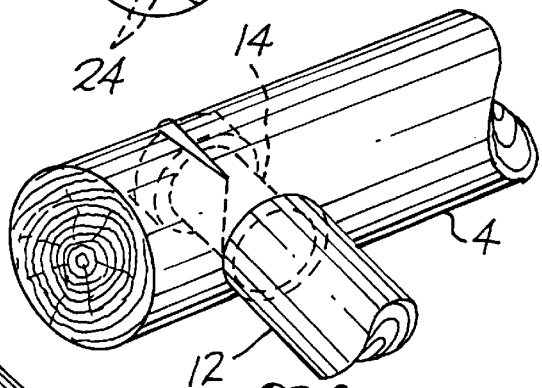

An alternative means of construction is seen in FIG. 8. This variation of the invention offers some construction advantages when larger diameter units are being made. In it, only some of the log pairs 8 are joined by spars 12. Logs adjacent to these are united to them by dowels 24 at one or preferably both ends of the structure. The dowels are placed so that they lie generally tangential to a circle centered on and normal to the longitudinal axis. The reason for not uniting all of the log pairs with spars is as follows. As an example, in a structure about 1 m in diameter formed from 16 small logs, using spars about 10 cm in diameter, the spars would occupy about 80 cm of space at each end. This represents a significant portion of the interior volume. In a structure about 5 m in length the spars would occupy about ⅓ of the interior volume. Since it is desirable in many cases to fill the structure with rock ballast, this loss of ballast space is quite significant. However, additional interior volume is gained by omitting some of the pairs of spars and using dowels instead. This construction can be advantageously used when the number of logs in the structure is greater than six. It may also be used when an uneven number of logs is required to form a structure of the desired diameter.

In most cases native rock gathered from the stream bed at the site of installation will be used to provide any necessary ballast. However, the ballast might also be imported material, such as limestone, which is frequently added to streams to help reduce natural or man caused acidity. Containing this within the structure provides an advantage over dumping lime rock into the river since the rock is kept in a "basket" above the sediments and in the flowing water, thereby increasing the rate of dissolution.

Large woody debris and log jams are reported to have a major influence on the storage of organic matter from leaves, needles and salmon carcasses in a stream system. It is expected that structures of the present invention will trap more organic debris than single logs, but less than log jams of equivalent volume.

Applicant has herein disclosed the best mode of construction of his invention. It will be evident to those skilled in the art that many variations not disclosed herein can be made that would still be within the spirit of the invention. It is the intent of the inventor that the scope of his invention be limited only as it is defined in the following claims.

I claim:

1. An engineered wood structure that comprises:

an even numbered plurality of logs arranged in side-by-side contact around a longitudinal axis into an essentially hollow, generally cylindrical or frustroconical structure, the logs located on opposite sides of the structure being joined into pairs by spars, one spar being located near each end of the logs, each spar lying on a line defining a diameter of the structure so that the spars are essentially normal to and pass through the longitudinal axis of the structure, adjacent log pairs having the spars sufficiently displaced longitudinally so that the spars of one pair may be in contact with the spars of an adjacent pair but otherwise do not interfere spatially, whereby the logs and spars when assembled form a rigid, unitary, interlocked structure capable of being handled and deployed as a unit.

2. The structure of claim 1 in which the ends of the spars are formed into tenons and mortised into the logs so as to extend substantially through the logs.

3. The structure of claim 2 in the mortises in the logs are formed so that the end closest to the longitudinal axis of the structure is of smaller diameter than the end adjacent the outside surface of the structure.

4. The structure of claim 3 in which the tenoned ends of the spars are formed to accept a wedging means.

5. The structure of claim 4 further including wedging means driven into the tenoned ends of the spars so as to expand the tenoned end into the larger diameter portion of the mortise in the log and firmly lock the spar into place.

6. The structure of claim 1 in which the logs have natural taper and the larger ends of the logs are all assembled side-by-side at one end of the structure.

7. The structure of claim 1 further including a plurality of radially extending protrusions on the structure, said protrusions serving as anchoring means to hold the structure in place.

8. The structure of claim 7 in which the protrusions are of generally conical configuration, the base being located adjacent the log to which it is attached.

9. The structure of claim 7 in which the protrusions are mortised into the logs.

10. The structure of claim 7 in which the protrusions are located adjacent one end of the structure.

11. The structure of claim 1 in which the ends of adjacent logs are doweled together at least at one end of the structure for increased strength.

12. A method of forming an essentially hollow generally cylindrical or frustroconical engineered wood structure which comprises:

assembling an even numbered plurality of logs;

further assembling a similar number of spars adapted to join the logs;

placing a first pair of logs spaced apart to the desired diameter of the structure on opposite sides of a longitudinal axis and joining the log pair with spars, one spar being located near each end of the logs;

locating a second pair of logs adjacent clockwise or counterclockwise to the first so that they begin to describe the cylindrical or frustroconical structure around the longitudinal axis and similarly joining the second pair with spars, the spars of the second log pair being sufficiently displaced longitudinally so that they may be in contact with but otherwise do not interfere spatially with the spars of the adjacent first log pair; and assembling additional pairs of logs and spars in side-by-side contact adjacent the other pairs to complete the cylindrical or frustroconical structure to the required diameter, wherein the logs and spars when assembled form a rigid, unitary, interlocked structure capable of being handled and deployed as a unit.

13. The method of claim 12 which further includes forming tenons on the ends of the spars, boring mortise openings through the logs, and mortising the tenons into the logs so that the tenons extend substantially through the logs.

14. The method of claim 13 in which includes forming the mortise openings so that the end closest to the longitudinal axis of the structure is of smaller diameters than the end adjacent the outside surface of the structure.

15. The method of claim 14 including forming the tenon ends of the spars to accept a wedging means.

16. The method of claim 15 including driving wedging means into the tenoned ends of the spars to expand them into the larger diameter portion of the mortise openings in the logs.

17. The method of claim 12 in which the logs have natural taper and assembling the larger ends of the logs side-by-side at one end of the structure.

18. The method of claim 17 including adding a plurality of radially extending protrusions to the structure.

19. The method of claim 18 in which the plurality of radially extending protrusions is added at one end of the structure.

20. The method of claim 18 in which the protrusions are of generally conical configuration with a base portion located adjacent to the log to which it is attached.

21. The method of claim 18 including mortising the protrusions into the logs.

22. The method of claim 12 including doweling adjacent logs together at least at one end to increase structural strength.

23. An engineered wood structure that comprises;

a plurality of relatively small logs arranged in side-by-side contact around a longitudinal axis into an essentially hollow, generally cylindrical or frustroconical structure, at least two pairs of logs located diametrically opposite each other on the structure being joined by spars, one spar being located near each end of the logs, each spar lying on a line defining a diameter of the structure so that the spars are essentially normal to and pass through the longitudinal axis of the structure, the spars being sufficiently displaced longitudinally so that the spars of one pair may be in contact with the spars of an adjacent pair but otherwise do not interfere spatially, adjacent logs being united by dowels at least at one end of the structure, said dowels lying generally tangentially to a circle drawn about the longitudinal axis, whereby the logs, dowels, and spars when assembled form a rigid, unitary, interlocked structure capable of being handled and deployed as a unit.

24. The structure of claim 23 in which the ends of the spars are formed into tenons and mortised into the logs so as to extend substantially through the logs.

25. The structure of claim 23 in which the logs have natural taper and the larger ends of the logs are all assembled side-by-side at one end of the structure.

26. The structure of claim 23 further including a plurality of radially extending protrusions on the structure, said protrusions serving as anchoring means to hold the structure in place.

* * * * *